US007340806B2

(12) United States Patent
Matsumoto et al.

(10) Patent No.: US 7,340,806 B2
(45) Date of Patent: Mar. 11, 2008

(54) OPENER FOR SLIDE FASTENER

(75) Inventors: Satoshi Matsumoto, Toyama (JP); Shigeyoshi Takazawa, Cheshire (GB)

(73) Assignee: YKK Corporation, Tokyo (JP)

( * ) Notice: Subject to any disclaimer, the term of this patent is extended or adjusted under 35 U.S.C. 154(b) by 151 days.

(21) Appl. No.: 11/154,343

(22) Filed: Jun. 16, 2005

(65) Prior Publication Data

US 2005/0278904 A1 Dec. 22, 2005

(30) Foreign Application Priority Data

Jun. 18, 2004 (JP) ..... 2004-181166

(51) Int. Cl.
*A44B 19/36* (2006.01)

(52) U.S. Cl. ..... 24/433

(58) Field of Classification Search ..... None
See application file for complete search history.

(56) References Cited

U.S. PATENT DOCUMENTS 7,036,191 B2 * 5/2006 Tsaur ..... 24/433

* cited by examiner

*Primary Examiner*—Jack W. Lavinder
(74) *Attorney, Agent, or Firm*—Alston & Bird LLP

(57) ABSTRACT

An opener for a slide fastener comprising an insert pin mounted on a bottom end of a fastener element, a notch portion provided in a main body portion thereof, a base portion provided on an upper side to be projected to a box pin side, an inserting portion that is to be inserted into the fastener element on the box pin side and provided protrudedly on the base portion, a mounting portion provided adjacent to the inserting portion so that a leg portion of the fastener element can be placed thereon, an accommodating portion for accommodating an engaging head of the fastener element provided between a projecting portion on top of the main body portion and the inserting portion, wherein the right and left fastener elements are captured by the insert pin thereby blocking separation due to push-up from a rear surface, when the inserting portion is inserted into the fastener elements.

4 Claims, 9 Drawing Sheets

OPENER FOR SLIDE FASTENER

BACKGROUND OF THE INVENTION

1. Field of the Invention

The present invention relates to a separable bottom end stop or an opener for a slide fastener comprising a box pin and an insert pin which separate and engage right and left fastener stringers on an end portion of a fastener chain formed by attaching linear fastener elements of thermoplastic resin mono-filament on side edges of fastener tapes.

2. Description of the Related Art

Conventionally, in an opener comprising a box 104 and a box pin 105 attached to one fastener stringer 101 and an insert pin 106 attached to the other fastener stringer 101 at an end portion of a fastener chain in which fastener elements 103 formed of thermoplastic resin mono-filaments are attached on side edges of fastener tapes, a hook-like engaging portion 120 is formed on a face opposing the box pin 105 at an upper end of the insert pin 106 integrally with the insert pin 106, and that hook-like engaging portion 120 is inserted into a back side of an engaging head 110 of a fastener element 103 adjoining the box pin 105 so that the insert pin 106 is engaged with the box 104, as shown in FIG. 15.

According to Taiwanese Patent No. 541881, as shown in FIG. 16, a rectangular column-like insert pin 206 of an opener has a contact plate 221 protrudedly provided on an opposing side with respect to the box pin 205, the contact plate 221 comprising a circular protrusion at its front end and a concave portion 217 inside so as to engage a circular groove and a hooking portion provided in the box pin 205, and an inserting portion 220 projecting upward in a subulate manner is provided on a flat portion on the top face of this contact plate 221, so that the inserting portion 220 can be inserted into a coil-like fastener element adjacent to the box pin 205 of an engagement mate from below.

The hook-like engaging portion 120 or the subulate inserting portion 220 provided on the insert pin 106, 206 of the opener shown in FIGS. 15 and 16 is produced by disposing an engaging portion 120 and an inserting portion 220 which can be just inserted into a mating fastener element 103 in the insert pin 106, 206 on a side opposing to the box pin 105, 205. If right and left fastener stringers 101 are engaged with each other with the insert pin 106, 206 and the box pin 105, 205 facing each other, the engaging portion 120 or the inserting portion 220 is likely to move in a space within the fastener element 103 and to be deformed easily and thereby being unstable, because the engaging portion 120 or the inserting portion 220 in the insert pin 106, 206 is just inserted into the mating fastener element 103.

SUMMARY OF THE INVENTION

The present invention has been achieved in view of the above-described problem and a first object of the present invention is to provide an opener for a slide fastener having a fastener chain with a sufficient strength, in which a linear fastener element on a side of a box pin of the opener is held by an insert pin securely, thereby accommodating a leg portion and an engaging head of the linear fastener element effectively in a stable condition to engage the insert pin with the linear fastener element, so that when the fastener chain is pushed up, that is, linear fastener elements are pushed up from a rear side of the fastener chain, the linear fastener elements are prevented from being deformed.

According to second to fifth aspects of the present invention, in addition to a first aspect of the present invention, there is provided an opener for a slide fastener in which an inserting portion which can be inserted into the linear fastener element and has a shape enabling the insert pin of the opener to capture the linear fastener element on the box pin side securely, a mounting portion on which a leg portion of the linear fastener element can be placed, and an accommodating portion capable of accommodating an engaging head of the linear fastener element are disposed on a top face of the insert pin so as to ensure an effective, stable engagement.

To achieve the above-described object, according to a first aspect of the present invention, in an opener for a slide fastener in which right and left linear fastener elements formed of polyamide base or polyester base mono-filament, for example, coil-like fastener elements or zigzag fastener elements are attached along opposing side edges of right and left fastener tapes, an insert pin is disposed on a bottom end of one linear fastener element and an inserting portion capable of being inserted into another linear fastener element when right and left linear fastener elements are engaged with each other is provided on an upper side of the insert pin so that it is protruded upward and a mounting portion on which a leg portion of the linear fastener element can be placed is provided continuously at a base portion of the inserting portion.

According to a second aspect of the present invention, in addition to the first aspect, the inserting portion and the mounting portion are disposed on a top face of a base portion that is projected sideways from a main body portion of the insert pin. A projecting portion is provided so as to be protruded upward from the main body portion and an accommodating portion capable of accommodating an engaging head of the linear fastener element is provided between the projecting portion and the mounting portion.

According to a third aspect of the present invention, in addition to the first aspect, the inserting portion to be inserted into the linear fastener element and the mounting portion on which the leg portion of the linear fastener element is to be placed are provided on a top face of a rectangular column-like base portion. A notch portion which is cut out in a trapezoidal form is formed in a lower portion of the insert pin and the base portion is provided above the notch portion such that it is projected from the main body portion toward a face opposing the box pin. The box pin has an engaging portion which is protruded in a form of an inverted triangle and capable of being fitted to the notch portion provided in the insert pin.

According to a fourth aspect of the present invention, in addition to the first aspect, the mounting portion on which the leg portion of the linear fastener element is to be placed is formed so as to become thicker gradually as it goes from a top face of the mounting portion toward the base portion in terms of thickness in a width direction of the mounting portion, in other words, a depth thereof.

According to a fifth aspect of the present invention, in addition to the first aspect, the mounting portion on which the leg portion of the linear fastener element is to be placed is located on a front side of the insert pin relative to the inserting portion to be inserted into the linear fastener element, in other words, it is located on a surface of a fastener stringer, so that one leg portion of the linear fastener element can be mounted.

As for effects of the present invention, because the first aspect of the invention attains an opener for a slide fastener provided with right and left linear fastener elements attached along opposing side edges of right and left fastener tapes wherein an insert pin is disposed at a bottom end of one of the linear fastener elements, a box pin is disposed at a bottom end of the other one of the linear fastener elements, and an inserting portion capable of being inserted into the other one of the linear fastener elements when right and left linear fastener elements are engaged with each other is provided protrudedly on a top side of the insert pin while a mounting portion for supporting a leg portion of the other one of the linear fastener elements is provided continuously at a base portion of the inserting portion, following effects are exerted.

Because the inserting portion and the mounting portion for supporting the leg portion are provided on the top side of the insert pin so that they are consecutive, the insert pin captures a first element of a fastener stringer on a side of the box pin, so that a fastener chain is highly resistant to push-up phenomenon.

Because the second aspect of the present invention provides the opener for the slide fastener according to the first aspect wherein the inserting portion and the mounting portion are disposed on a top face of a base portion projected sideways from a main body portion of the insert pin and a projecting portion which is projected upward from the main body portion is provided while an accommodating portion capable of accommodating the engaging head of the linear fastener element is provided between the projecting portion and the mounting portion, the engaging head of the fastener element can be held in a stable condition without slippage.

Because the third aspect of the present invention provides the opener for the slide fastener according to the first aspect wherein the inserting portion and the mounting portion are disposed on a top face of a rectangular column-like base portion projected from the main body portion to an opposing face of the box pin while a notch portion is provided in a main body portion of the insert pin, the inserting portion and the mounting portion are disposed on the firm rectangular column-like base portion, so that the opener endures long-term use without being deformed. Further, an engaging portion capable of being fitted to the notch portion is formed in the box pin so that the insert pin and the box pin can be engaged with each other firmly.

Because the fourth aspect of the present invention provides the opener for the slide fastener according to the first aspect wherein a thickness in a width direction of the mounting portion is increased as it goes from a top face of the mounting portion to the base portion, it substantially meets a shape of a rear face of an engaging head of the linear fastener element and the insert pin is easily engaged with the first fastener element on a box pin side by the inserting portion and the mounting portion so that both of them closely engage with other and never rattle. Consequently, a high quality fastener chain can be manufactured.

Because the fifth aspect of the present invention provides the opener for the slide fastener according to the first aspect wherein the mounting portion is located on a side of a front face of the insert pin with respect to the inserting portion while one of right and left leg portions of the linear fastener elements is placed on the mounting portion, when right and left fastener stringers are engaged with each other, the leg portion of the first fastener element on the box pin side is disposed on a side of a front surface of one of the fastener stringers so that it is placed neatly on the mounting portion. Consequently, a fastener chain with an excellent appearance can be manufactured. The effects which the present invention can exert are extremely remarkable.

DESCRIPTION OF THE PREFERRED EMBODIMENTS

Figure 1:
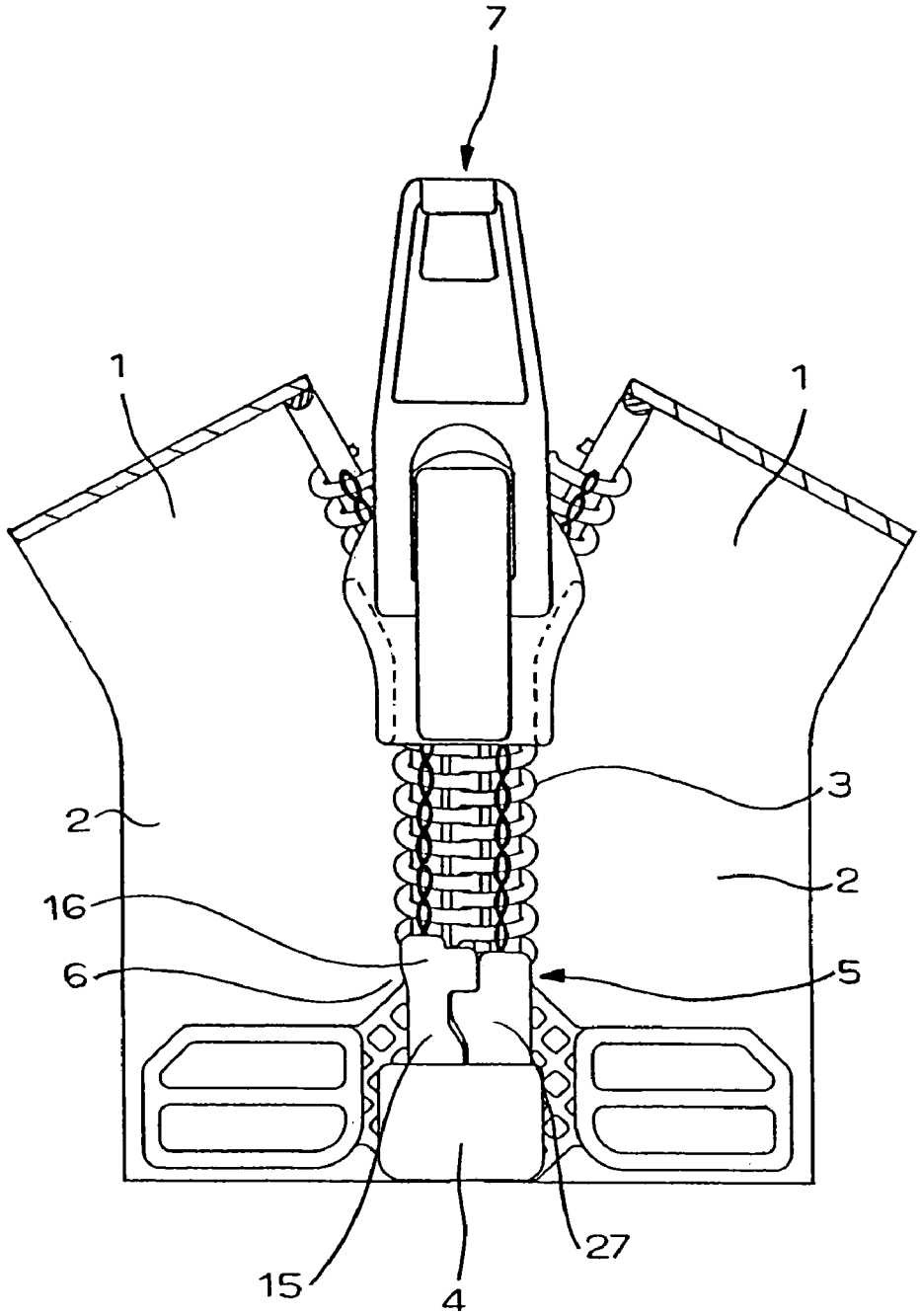
FIG. 1 is a front view of a slide fastener having an opener.

In an opener for a slide fastener of the present invention, as shown in FIG. 1, coil-like fastener elements or zigzag linear fastener elements 3 formed from polyamide base or polyester base mono-filament are attached along opposing side edges of a pair of fastener tapes 2 so as to constitute right and left fastener stringers 1. A box 4 and a box pin 5 of thermoplastic resin are mounted on a bottom end of one fastener stringer 1 by integral molding and an insert pin 6 of resin is mounted on a bottom end of the other fastener stringer 1 so as to constitute an opener altogether.

In the coil-like fastener element 3, an engaging head 10 and leg portions 11 extending in a width direction of each fastener tape 2 from upper and lower ends of this engaging head 10 are formed in a vertical direction while adjoining fastener elements 3 are joined together through their upper and lower leg portions 11 obliquely by a combining portion 12 so as to constitute a continuous fastener element row. In the zigzag fastener element, although not shown, the engaging head and the leg portions extending in the width direction of the fastener tape from the upper and lower ends of the engaging head are formed such that they overlap each other in a vertical direction and ends of the upper and lower leg portions connect a next fastener element horizontally by the combining portion so as to constitute a continuous fastener element row.

Figure 3:
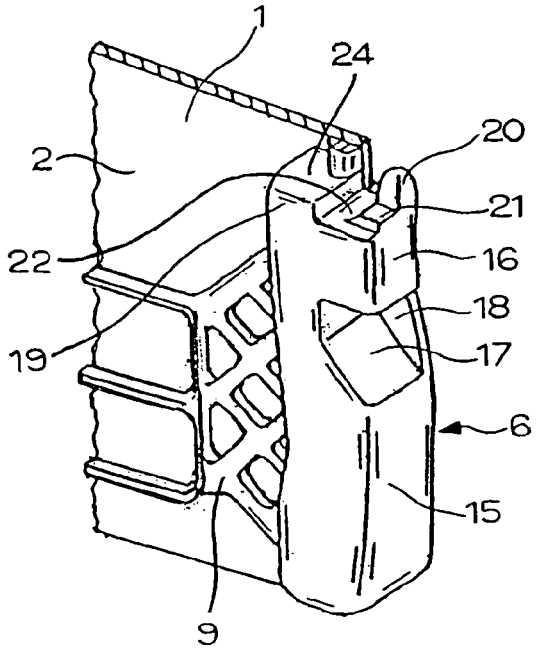
FIG. 3 is a perspective view of an insert pin of the same opener.
Figure 5:
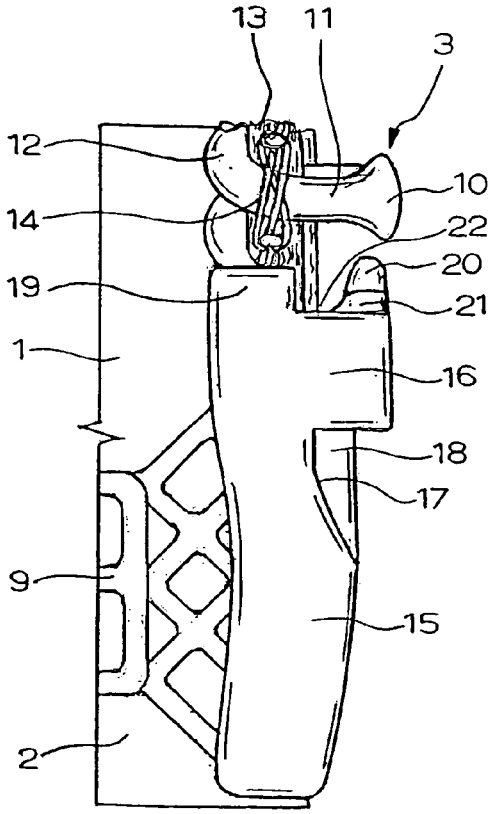
FIG. 5 is a front view of the insert pin of the same opener.
Figure 7:
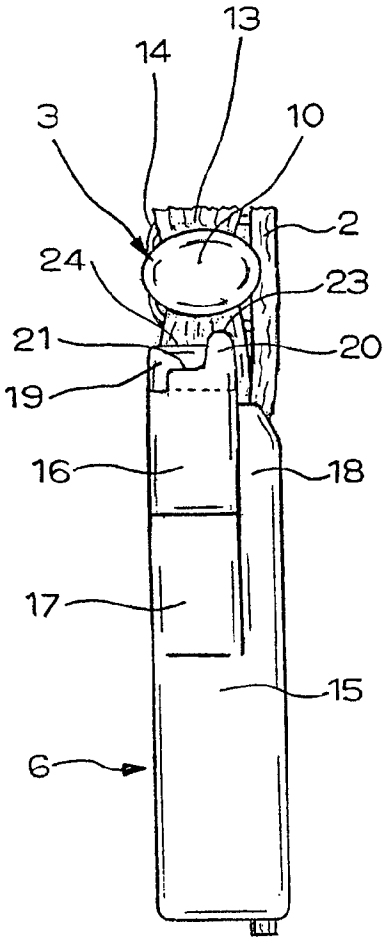
FIG. 7 is a side view of the insert pin of the same opener.

As shown in FIGS. 3, 5 and 7, the insert pin 6 of the opener is provided with a notch portion 17 which is cut out in a form of an inverted triangle at an intermediate portion of a rectangular column-like main body portion 15 while a rectangular column-like base portion 16 is disposed above the notch portion 17 and a side wall 18 continuous from the base portion 16 is disposed on a side of the notch portion 17. On a top face of the base portion 16 and at a front end on a side opposing the box pin 5, there is provided an inserting portion 20 which can be inserted into an engaging object, namely, a rear side of the engaging head 10 of the linear fastener element 3 on the side of the box pin 5 so that it is projected upward. A vertex 23 of the inserting portion 20 is formed so as to project over a top face 24 of the main body portion 15. A mounting portion 21 whose height is lower than the inserting portion 20 and on which the leg portion 11 of the linear fastener element 3 can be mounted is continuously provided adjacent to the inserting portion 20 and further, an accommodating portion 22 capable of accommodating the engaging head 10 of the linear fastener element 3 is provided, in which a concave-shaped clearance corresponding to a shape of a rear face of the engaging head 10 is provided at a base portion of the inserting portion 20 and the mounting portion 21 with respect to a projecting portion 19 of the main body portion 15 in the insert pin 6.

Figure 4:
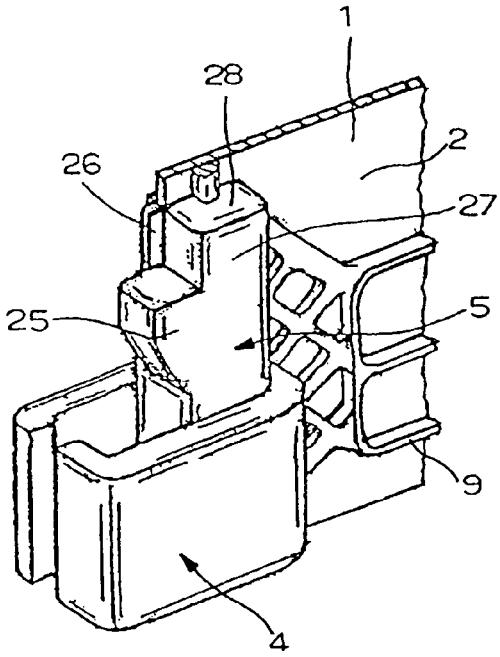
FIG. 4 is a perspective view of a box and a box pin of the same opener.
Figure 6:
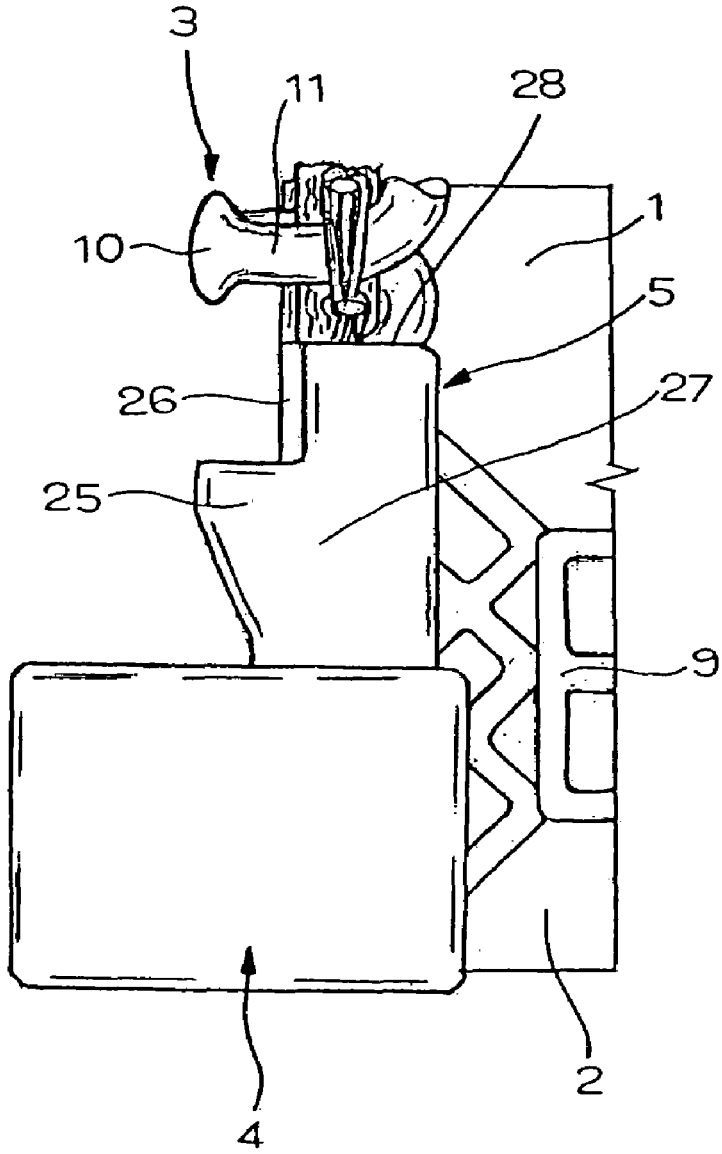
FIG. 6 is a front view of the box and the box pin of the same opener.
Figure 8:
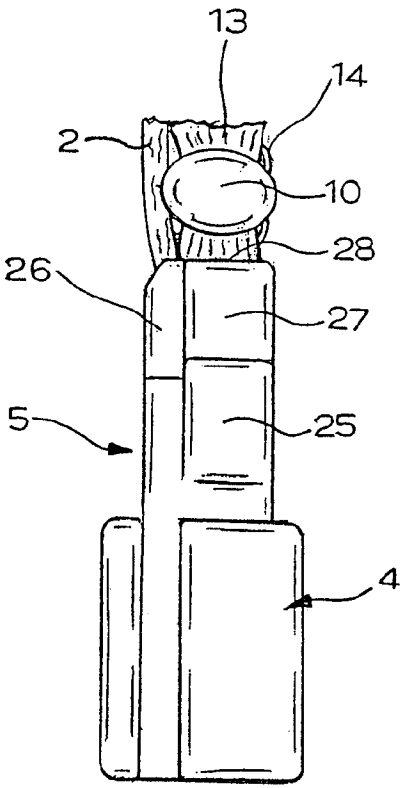
FIG. 8 is a side view of the box and the box pin of the same opener.
Figure 14:
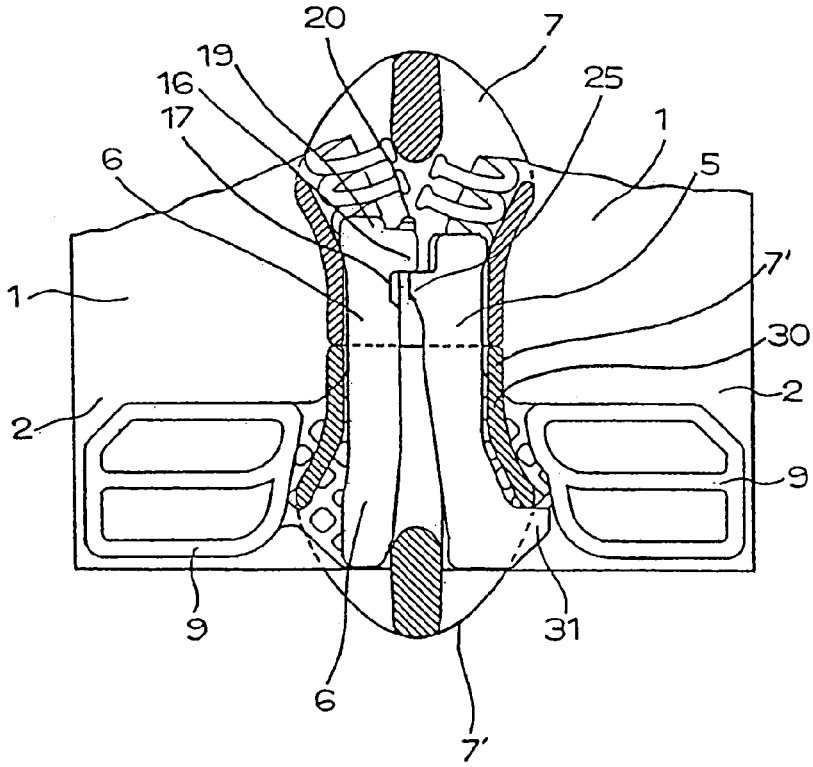
FIG. 14 is a partially broken sectional view of a reverse opening portion.
Figure 15:
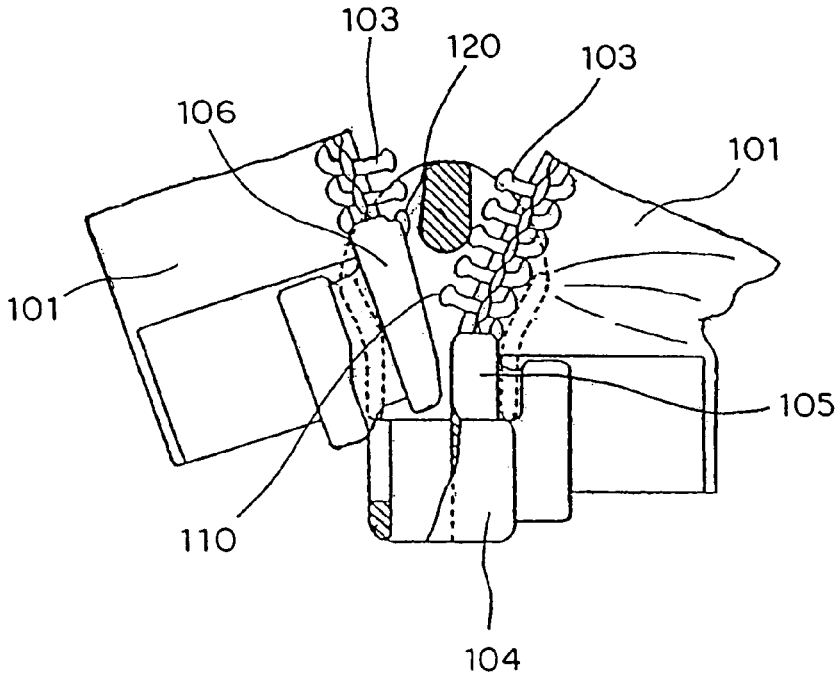
FIG. 15 PRIOR ART
FIG. 15 is a front view of a well known opener.
Figure 16:
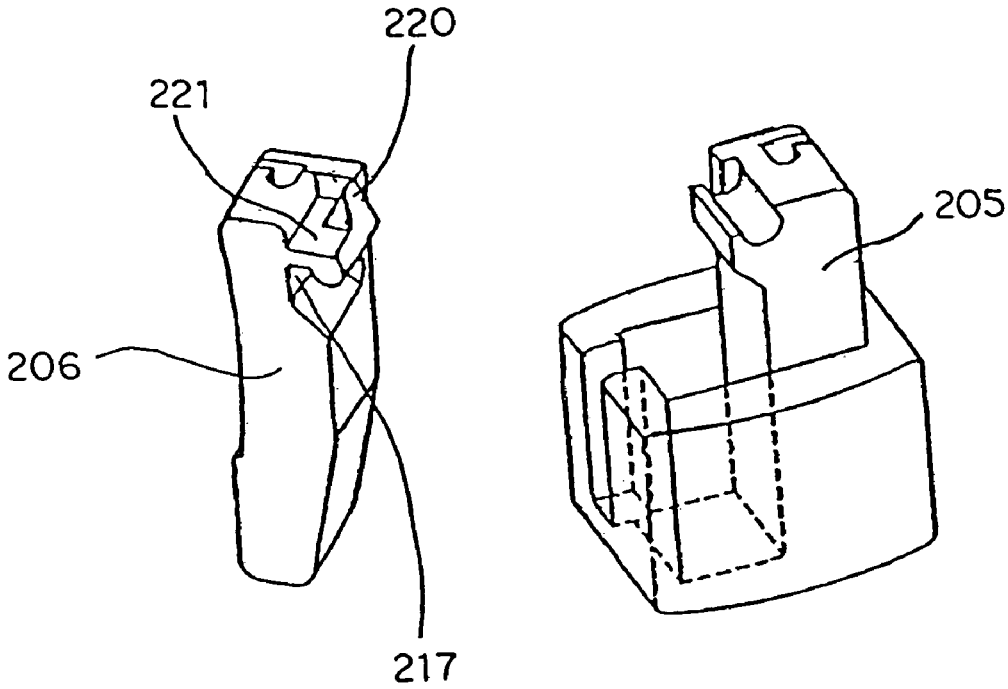
FIG.16 PRIOR ART
FIG. 16 is a diagram showing an insert pin of another well known opener.

As shown in FIGS. 4, 6 and 8, the box 4 into which the insert pin 6 can be inserted is integrally provided on a bottom of the box pin 5 and the rectangular column-like box pin 5 is provided on this box 4 such that it is projected upward. The box pin 5 has an engaging portion 25 which is projected in the form of an inverted triangle, capable of being fitted into the notch portion 17 provided in the insert pin 6 and further, a projected piece 26 which makes contact with a side face of the base portion 16 of the insert pin 6 is provided protrudedly on a face opposing the insert pin 6 above the engaging portion 25 so that it can withstand a push-up action when the insert pin 6 is inserted. A top face of the box pin 5 is formed so as to be on a same plane as the top face of the base portion 16. In the meantime, it is permissible to form the box 4 and the box pin 5 separately and equip a reverse opening slider 7' instead of the box 4 as shown in FIG. 14 to be used as a reverse opener.

First Embodiment

Figure 2:
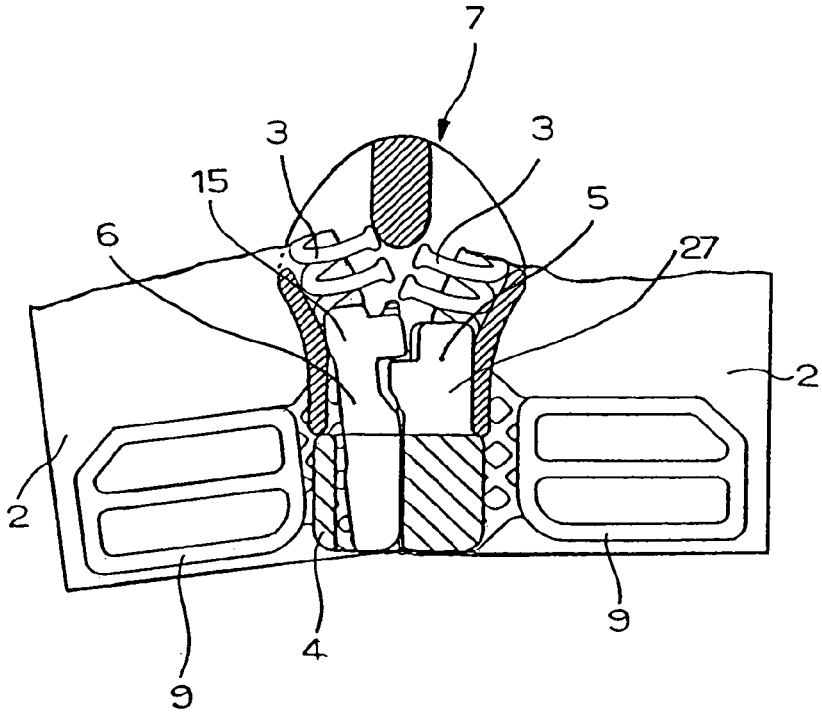
FIG. 2 is a partially broken front view at a time of opening start of a fastener chain in the same opener.

An opener for a slide fastener of an embodiment shown in FIGS. 1 to 10 will be described. In right and left fastener stringers 1 as shown in FIGS. 1 and 2, linear fastener elements 3 are formed by forming mono-filaments in a coil-like or zigzag form with polyamide or polyester on opposing side edges of fastener tapes 2 and a core thread 13 is made to run through these linear fastener elements 3 and sewed with a sewing thread 14 so as to form each of the fastener stringers 1. Alternatively, it is permissible to weave or knit the linear fastener elements 3 in the fastener tapes 2 when the fastener tapes are woven or knitted. A box 4 and a box pin 5 into which an insert pin 6 can be inserted are formed integrally and attached to a bottom end of one fastener stringer 1 of the paired fastener stringers 1 produced and the insert pin 6 which is inserted into the box 4 is formed and attached to the bottom end of the other fastener stringer 1 so as to constitute the opener. Meanwhile, the box 4, the box pin 5 and the insert pin 6 are attached to the side edges of the fastener tapes 2 by injection molding means using thermoplastic resin such as polyacetal and polyamide.

As for the insert pin 6 to be attached to the fastener stringer 1, as shown in FIGS. 3, 5 and 7, the rectangular column-like insert pin 6 is mounted so as to closely hold front and rear faces on the side edge of one of the fastener tapes 2 and at a same time, a reinforcement portion 9 is formed integrally on both the front and rear faces of the fastener tape 2. A notch portion 17 which is cut out in a form of an inverted triangle is provided in the intermediate portion of a main body portion 15 of this insert pin 6 and a base portion 16 which is projected sideways in a form of a rectangular column is provided above the notch portion 17 such that it is lower than a top face 24 of the main body portion 15. A side wall 18 continuous from the base portion 16 is provided on a side of the fastener tape 2 of the notch portion 17 so as to be capable of making contact with a side face of an engaging portion 25 of the box pin 5, thereby preventing the insert pin 6 and the box pin 5 from swinging in a direction of the front and rear faces.

An inserting portion 20 which can be inserted in a rear side of an engaging head 10 of the linear fastener element 3 which is an engaging object is provided on a top face of the base portion 16 formed on the main body portion 15 of the insert pin 6 and at a front end of a side opposing the box pin 5, namely on a side which makes contact with the box pin 5 when the insert pin 6 is fitted into the box 4. The inserting portion 20 is formed in a slightly sharp edge structure so as to facilitate an insertion operation. Further, a vertex 23 of the inserting portion 20 is formed so as to be protruded over the top face 24 of the main body portion 15 to prevent the engaging head from loosing out easily and further, by forming the top face 24 of the main body portion 15 lower, the side edge of the fastener stringer 1 is easy to be bent. A mounting portion 21 whose height is lower than the inserting portion 20 is continuously provided adjacent to this inserting portion 20 such that the mounting portion 21 is projected upward, the mounting portion being capable of catching and holding a leg portion 11 of the linear fastener element 3. The mounting portion 21 is disposed on a side of a front surface of the fastener stringer 1 of the inserting portion 20. A base portion of the inserting portion 20 and the mounting portion 21 is formed into a shape corresponding to a shape of a rear surface of the engaging head 10 of the linear fastener element 3 and a concave accommodating portion 22 capable of accommodating the engaging head 10 of a concave shape is formed so as to securely hold the engaging head 10 between the base portion of the inserting portion 20 and the mounting portion 21 and the main body portion 15.

As shown in FIGS. 4, 6 and 8, the box 4 attached to the fastener stringer 1 is provided so that the box pin 5 formed of a rectangular column-like main body portion 27 on the front and rear faces of the fastener tape 2 is extended upward along the side edge of the fastener tape 2. The box 4 disposed below the box pin 5 is capable of receiving the insert pin 6 and the reinforcement portion 9 made of resin and formed integrally with the box pin 5 and the box 4 is formed on the front and rear surfaces of the bottom end of the fastener tape 2. A top face 28 of the box pin 5 is formed to be on a same plane as the top face of the base portion 16 of the insert pin 6 and the engaging portion 25 which is protruded in the form of an inverted triangle and capable of being fitted into the notch portion 17 in the insert pin 6 is provided in the intermediate portion of the main body portion 27. A projected piece 26 is provided on a side edge of the main body portion 27 above this engaging portion 25 such that the projected piece 26 meets the edge of the fastener tape 2, so that it is capable of making contact with a side face of the base portion 16 of the insert pin 6. Consequently, the box pin 5 and the insert pin 6 are prevented from swinging in directions of the front and rear faces.

Figure 9:
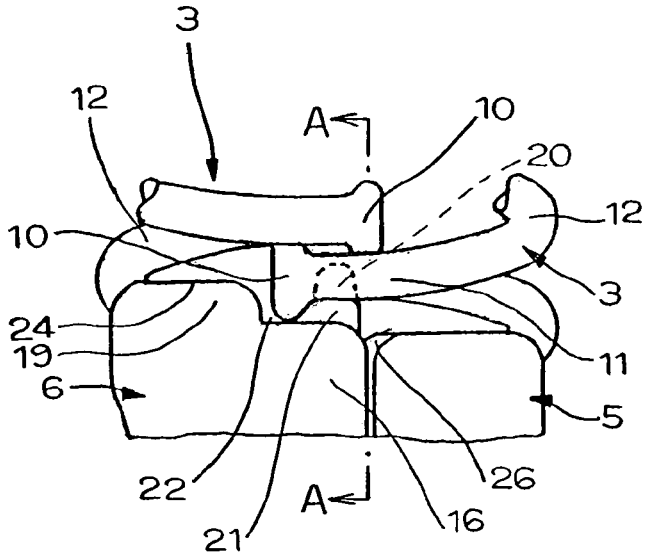
FIG. 9 is a front view of major portions of the same opener.
Figure 10:
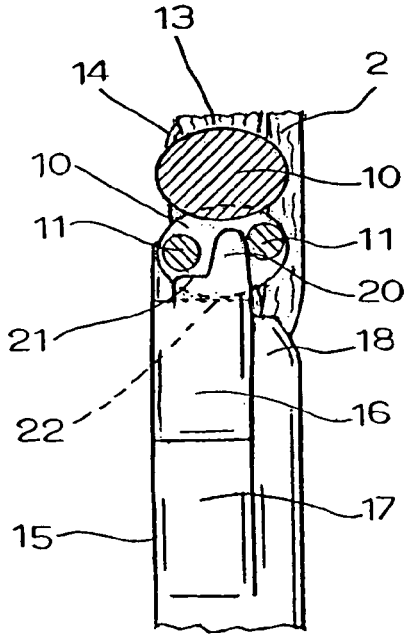
FIG. 10 is a sectional view taken along a line A-A in FIG. 9 of the opener.

When the right and left fastener stringers 1 provided with the box 4, the box pin 5 and the insert pin 6 are engaged with each other by a slider 7 as shown in FIGS. 9 and 10, the engaging head 10 of the first fastener element 3 on the side of the box pin 5 is inserted into the inserting portion 20 formed in the insert pin 6 and the leg portion 11 continuously disposed from the engaging head 10 is placed on the mounting portion 21. Consequently, the engaging head 10 is accommodated in the accommodating portion 22 formed with respect to the main body portion 15 so that the engaging head 10 does not swing, thereby maintaining an engagement condition firmly in a stable condition.

In reinforcement portions 9 provided on the box pin 5 and the insert pin 6, as shown in FIG. 1, top sides of the insert pin 6 and the box pin 5 are formed obliquely. Particularly, on the side of the insert pin 6, the main body portion 15 of the insert pin 6 on a side of the reinforcement portion 9 is dented inward. As a result, when the insert pin 6 and the reinforcement portion 9 are formed by injection molding, a joining area between the insert pin 6 and the reinforcement portion 9 is small and a strength is weak. Thus, the reinforcement portion 9 is formed obliquely up to above a dent portion in the insert pin 6 and as a consequence, a sufficient joining strength can be obtained.

Figure 11:
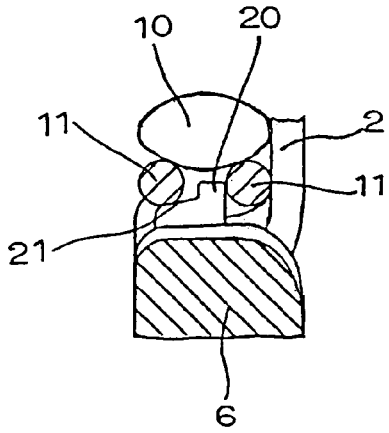
FIG. 11 is a sectional view showing a modification of a mounting portion formed on the insert pin of the opener.
Figure 12:
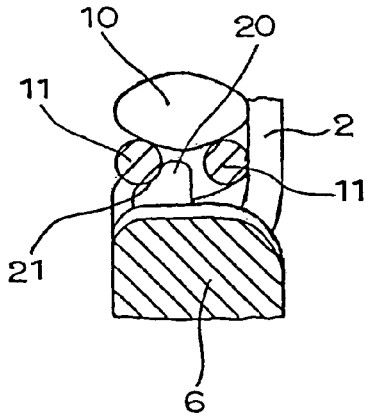
FIG. 12 is a sectional view showing another modification of the mounting portion formed on the insert pin of the opener.
Figure 13:
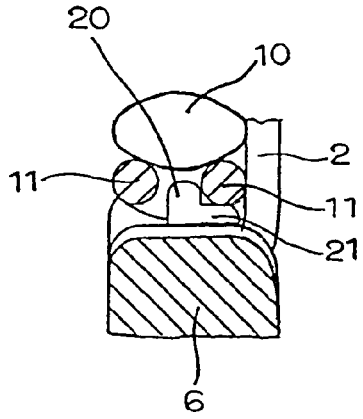
FIG. 13 is a sectional view showing still another modification of the mounting portion formed on the insert pin of the opener.

A modification shown in FIG. 11 indicates a modification of the mounting portion 21 on which the leg portion 11 of the linear fastener element 3 is placed and the top face of the mounting portion 21 is slightly inclined from a side of the inserting portion 20 to an outside. According to a modification shown in FIG. 12, a surface of the mounting portion 21 is formed to correspond to an external face of the leg portion 11 of the linear fastener element 3. According to a modification shown in FIG. 13, the mounting portion 21 is formed between the inserting portion 20 and the fastener tape 2. Further, the mounting portion 21 can be disposed on both sides of the inserting portion 20.

According to an embodiment shown in FIG. 14, the present invention is applied to a box pin and an insert pin of a reverse opener. Instead of providing the box, a reverse opening slider 7' is made to run through the fastener stringer 1 having the box pin 5 and the box pin 5 is formed slightly longer and a stopper 31 projected sideways is provided at a front end thereof so as to be capable of engaging a flange 30 of the slider 7'. A length of the insert pin 6 is set slightly longer corresponding to the box pin 5 and the inserting portion 20, the mounting portion 21 and the accommodating portion 22 of the above-described structures are provided on the top face of the base portion 16 of the insert pin 6.

The opener for the slide fastener of the present invention is the slide fastener with the opener in which the box, the box pin and the insert pin are made of resin and which is attached to an opening portion in each of various kinds of clothes and an opening of a bag or the like and particularly is preferable when it is attached to a front fly portion of a jumper or overcoat whose front portion is opened.

What is claimed is:

1. An opener for a slide fastener in which right and left linear fastener elements made of resin are attached along opposing side edges of right and left fastener tapes, the opener comprises an insert pin disposed at a bottom end of one of the liner fastener elements and a box pin disposed at a bottom end of the other one of the linear fastener elements, wherein an inserting portion to be inserted into the other one of the linear fastener elements when the right and left linear fastener elements are engaged with each other is provided protrudedly on an upper side of the insert pin while a mounting portion for supporting a leg portion of the other one of the linear fastener elements is provided continuously at a base portion of the inserting portion, and the inserting portion and the mounting portion are disposed on a top face of a base portion projected sideways from a main body portion of the insert pin and a projecting portion which is projected upward from the main body portion is provided while an accommodating portion for accommodating an engaging head of the linear fastener element is provided between the protection portion and the mounting portion.

2. The opener for a slide fastener according to claim 1, wherein the base portion is of a rectangular column-like base portion projected from the main body portion toward an opposing face of the box pin while a notch portion is provided in the main body portion of the insert pin and an engaging portion to be fitted into the notch portion is formed in the box pin.

3. The opener for a slide fastener according to claim 1, wherein a thickness in width direction of the mounting portion is gradually increased from a top face of the mounting portion to the base portion.

4. The opener for a slide fastener according to claim 1, wherein the mounting portion is located on a side of a front face of the insert pin with respect to the inserting portion while one of right and left leg portions of the linear fastener elements is placed on the mounting portion.

* * * * *